US009541858B2

(12) United States Patent
Ikeda

(10) Patent No.: US 9,541,858 B2
(45) Date of Patent: Jan. 10, 2017

(54) DEVELOPING DEVICE AND IMAGE FORMING APPARATUS

(71) Applicant: FUJI XEROX CO., LTD., Tokyo (JP)

(72) Inventor: Akira Ikeda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/840,502

(22) Filed: Aug. 31, 2015

(65) Prior Publication Data

US 2016/0274490 A1 Sep. 22, 2016

(30) Foreign Application Priority Data

Mar. 18, 2015 (JP) ..... 2015-055041

(51) Int. Cl.
*G03G 15/10* (2006.01)
*G03G 15/08* (2006.01)
*G03G 13/10* (2006.01)

(52) U.S. Cl.
CPC ..... *G03G 15/0822* (2013.01); *G03G 13/10* (2013.01); *G03G 15/10* (2013.01); *G03G 15/104* (2013.01); *G03G 2215/0626* (2013.01); *G03G 2215/0658* (2013.01)

(58) Field of Classification Search
CPC .... G03G 13/10; G03G 15/0822; G03G 15/10; G03G 15/104; G03G 2215/0626; G03G 2215/0658
See application file for complete search history.

(56) References Cited

U.S. PATENT DOCUMENTS

2008/0298843 A1* 12/2008 Hobo ..... G01F 23/226 399/238
2009/0052948 A1* 2/2009 Ozerov ..... G03G 15/104 399/239
2011/0103840 A1* 5/2011 Oda ..... G03G 15/104 399/240
2011/0249990 A1* 10/2011 Izawa ..... G03G 15/104 399/238
2014/0212176 A1 7/2014 Berg

FOREIGN PATENT DOCUMENTS

JP 2008-170601 A 7/2008
JP 2008-170603 A 7/2008
JP 2014-146032 A 8/2014

* cited by examiner

*Primary Examiner* — Ryan Walsh
(74) *Attorney, Agent, or Firm* — Oliff PLC

(57) ABSTRACT

A developing device, includes a developing member that forms a first nip with a latent image forming member on which a latent image is formed, and develops the latent image as a toner image using a developer containing a toner and a first liquid, a first supply member that forms a second nip with the developing member, and supplies the developer to the developing member, and a second supply member that faces the developing member at an upstream of the first nip in the developing member in a rotation direction of the developing member and at a downstream of the second nip, and supplies a second liquid to the developing member.

12 Claims, 12 Drawing Sheets

FIG. 9

| COMPONENTS | CONDITIONS |
| --- | --- |
| FIRST SUPPLY ROLL 72 | +0.8 V APPLIED |
| DEVELOPING ROLL 74 | +0.4 V APPLIED |
| CHARGING DEVICE 76 | +4 kV (700 μA) TO WIRES, +0.5 kV TO GRID ELECTRODE |
| PHOTORECEPTOR 60 | SURFACE POTENTIAL OF NON-IMAGE PORTION +0.6 kV SURFACE POTENTIAL OF IMAGE PORTION +0.05 kV |
| TRANSFER DEVICE 80 | −0.3 kV TO FIRST ROLL 82 −0.5 kV TO SECOND ROLL 84 |
| CIRCUMFERENTIAL SPEED OF ABOVE COMPONENTS, TRANSPORT SPEED OF MEDIUM P | 100mm/s |
| PROPORTION OF TONER T IN DEVELOPER G SUPPLIED FROM FIRST SUPPLY ROLL 72 | 36 TO 37% |
| LAYER THICKNESS OF DEVELOPER G SUPPLIED FROM FIRST SUPPLY ROLL 72 AND FORMED ON DEVELOPING ROLL 74 | 5 μm |

FIG. 10

| EXAMPLES AND COMPARATIVE EXAMPLE | UNIQUE CONDITIONS OF EACH EXAMPLE |
|---|---|
| FIRST EXAMPLE | CONDITIONS OF CHARGING DEVICE 76<br>· +3 kV (500 μA) TO WIRES,<br>· +0.3 kV IN GRID ELECTRODE<br>ADHERENCE AMOUNT OF LIQUID L BY SECOND SUPPLY ROLL 78<br>· CORRESPONDING TO 3 μm FILM THICKNESS ON DEVELOPING ROLL 74 |
| SECOND EXAMPLE | CONDITIONS OF CHARGING DEVICES 76, 76A<br>· +3 kV (500 μA) TO WIRES,<br>· +0.3 kV IN GRID ELECTRODE<br>ADHERENCE AMOUNT OF LIQUID L BY SECOND SUPPLY ROLL 78<br>· CORRESPONDING TO 3 μm FILM THICKNESS ON DEVELOPING ROLL 74 |
| THIRD EXAMPLE | VOLTAGE APPLIED TO SECOND SUPPLY ROLL 78<br>· +0.5 kV<br>ADHERENCE AMOUNT OF LIQUID L BY SECOND SUPPLY ROLL 78<br>· CORRESPONDING TO 3 μm FILM THICKNESS ON DEVELOPING ROLL 74 |
| COMPARATIVE EXAMPLE | CONDITIONS OF CHARGING DEVICE 76<br>· +3 kV (500 μA) TO WIRES,<br>· +0.3 kV TO GRID ELECTRODE |

FIG. 11

| EXAMPLE OR COMPARATIVE EXAMPLE | IMAGE FORMING DEVICE | REFERENCE DRAWINGS | IMAGE QUALITY EVALUATION ITEMS | |
|---|---|---|---|---|
| | | | FOGGING | PERCEIVED ROUGHNESS |
| FIRST EXAMPLE | 10 | FIGS. 1 AND 2 | B (PASS) | B (PASS) |
| SECOND EXAMPLE | 10E | FIG. 8 | A (PASS) | B (PASS) |
| THIRD EXAMPLE | 10B | FIG. 5 | A (PASS) | A (PASS) |
| COMPARATIVE EXAMPLE | 10A | FIG. 3 | C (FAIL) | C (FAIL) |

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2015-055041 filed Mar. 18, 2015.

BACKGROUND

Technical Field

The invention relates to a developing device and an image forming apparatus.

SUMMARY

According to an aspect of the invention, there is provided a developing device, including:

a developing member that forms a first nip with a latent image forming member on which a latent image is formed, and develops the latent image as a toner image using a developer containing a toner and a first liquid;

a first supply member that forms a second nip with the developing member, and supplies the developer to the developing member; and a second supply member that faces the developing member at an upstream of the first nip in the developing member in a rotation direction of the developing member and at a downstream of the second nip, and supplies a second liquid to the developing member.

BRIEF DESCRIPTION OF THE DRAWINGS

Exemplary embodiments of the present invention will be described in detail based on the following figures, wherein:

FIG. 9 is a table summarizing the common conditions of the tests (evaluation tests) of the examples (the first to the third examples) and the comparative example;

FIG. 10 is a table summarizing the unique conditions of the tests (evaluation tests) of the examples (the first to the third examples) and the comparative example;

FIG. 11 is a table summarizing the results of the image quality evaluation of the examples (the first to the third examples) and the comparative example.

DETAILED DESCRIPTION

Outline

Figure 1:
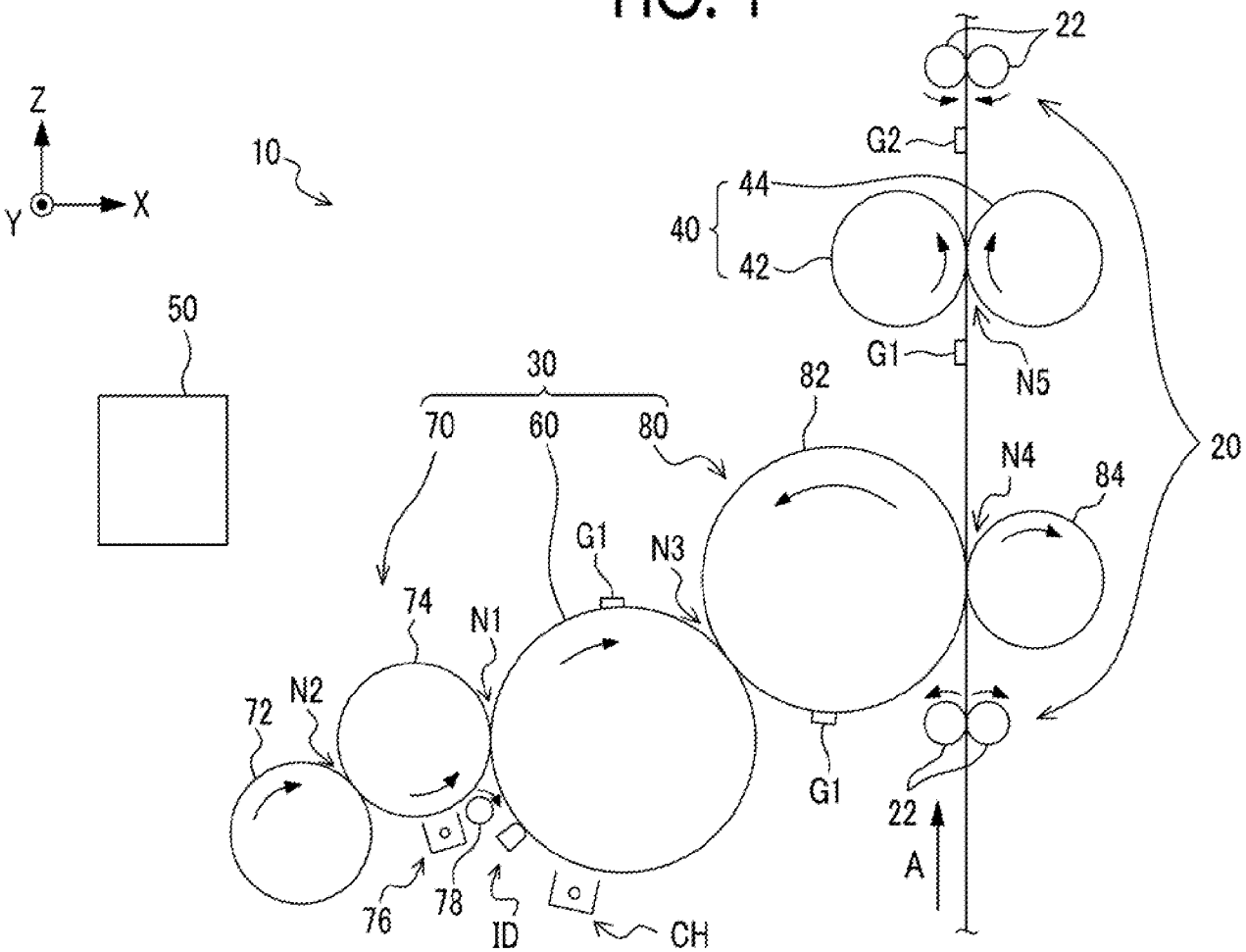
FIG. 1 is a schematic diagram (a front diagram) of an image forming apparatus of a first exemplary embodiment.

Hereinafter, description will be given of five exemplary embodiments (the first to fifth exemplary embodiments) for carrying out the invention (hereinafter referred to as exemplary embodiments). Next, description is given of the examples.

Note that, in the description hereinafter in the referenced drawings, a direction indicated by an arrow X is an apparatus width direction, and a direction indicated by an arrow Y in the drawings is an apparatus depth direction. A direction (a direction of an arrow Z) which orthogonally intersects both the apparatus width direction and the apparatus depth direction is an apparatus height direction.

First Exemplary Embodiment

Hereinafter, description will be given of the configuration of an image forming apparatus 10 of the first exemplary embodiment with reference to the drawings, then, of the operations of the image forming apparatus 10 of the present exemplary embodiment with reference to the drawings, and then, of the mechanisms of the present exemplary embodiment.

The image forming apparatus 10 of the present exemplary embodiment includes a function of forming a toner image G1 on a photoreceptor 60 (described later) using a liquid developer G (described later, hereinafter referred to as the developer G), transferring the toner image G1 to a medium P, and further fixing the toner image G1 to the medium P to form an image G2 on the medium P (refer to FIG. 1).

Figure 2:
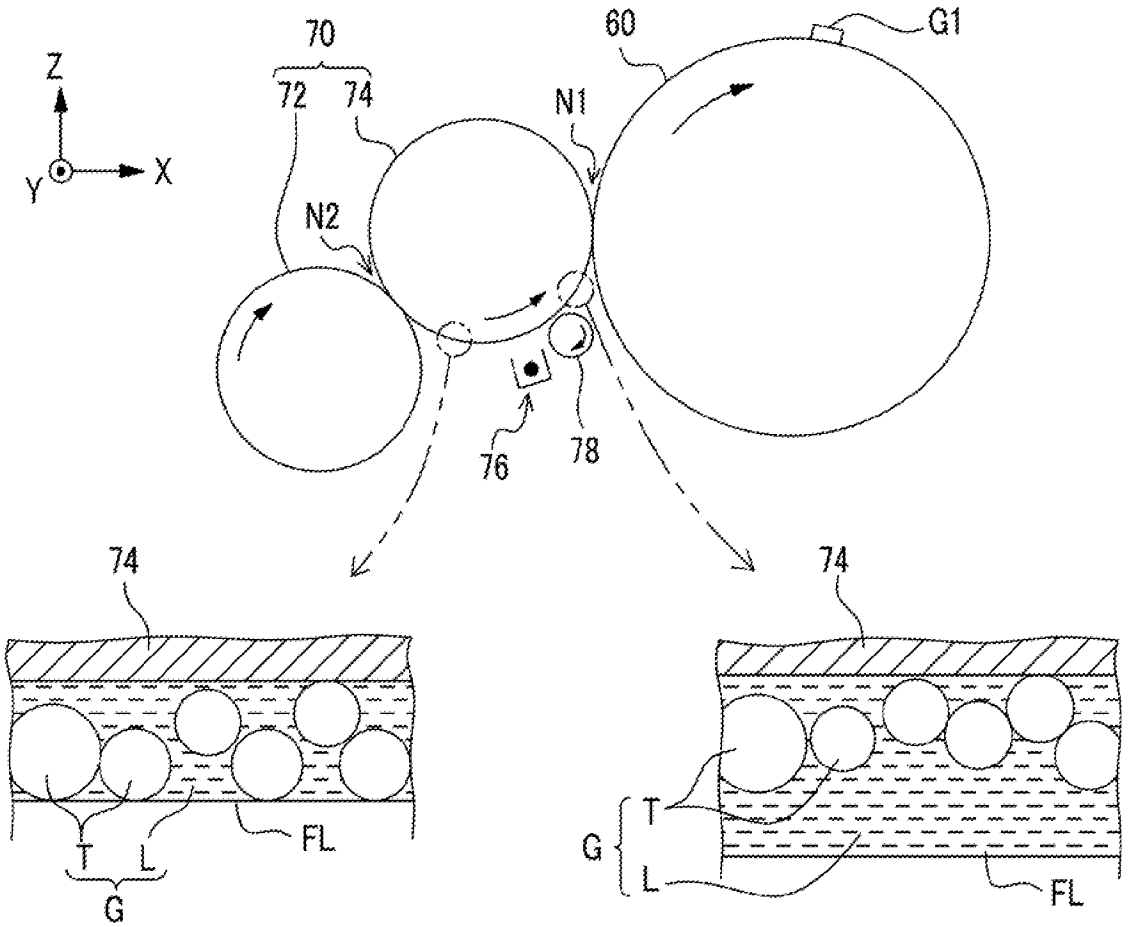
FIG. 2 is a schematic diagram (a front diagram) of a portion of a toner image forming member which configures the image forming apparatus of the first exemplary embodiment.

Here, the developer G is a liquid type developer which is obtained by dispersing a powder toner T in a liquid L (refer to FIG. 2). The toner T of the present exemplary embodiment is of a positive polarity (the average of the charge distribution is positive), for example. The liquid L of the present exemplary embodiment is a non-volatile oil, for example. Note that, the term "non-volatile" means that the flash point is 130° C. or higher, or, that the volatile matter content is 8 weight % or less after 24 hours in a room environment at 150° C.

Configuration

As illustrated in FIG. 1, the image forming apparatus 10 is configured to include a transport device 20, a toner image forming member 30, a fixing device 40, and a control section 50.

Transport Device

The transport device 20 includes a function of feeding the medium P (continuous paper, for example) along a transport path, transporting the medium P in an arrow A direction (the transport direction) illustrated in FIG. 1 at a predetermined transport speed, and winding the medium P on which the image G2 is formed (refer to FIG. 1). The transport device 20 is configured to include plural transport rolls 22, and a winding section (not shown) which winds the medium P. Note that, the winding section is cylindrical and capable of rotating around an axis due to a drive source (not shown), and is configured to wind the medium P on which the image G2 is formed while rotating around the axis.

Toner Image Forming Member

The toner image forming member 30 includes a function of transferring the toner image G1 which is formed on the photoreceptor 60 using the developer G onto the medium P to form the toner image GL on the medium P. As illustrated in FIG. 1, the toner image forming member 30 is configured to include the photoreceptor 60, a charging device CH, an exposure device ID, a developing device 70, and a transfer device 80.

Photoreceptor, Charging Device, and Exposure Device

The photoreceptor 60 includes a function of holding the toner image G1 which is developed by the developing device 70 (described later). The photoreceptor 60 is cylindrical, and is configured to rotate around an axis due to a drive source (not shown). Note that, the photoreceptor 60 is disposed in a state in which the axis thereof is parallel with the apparatus depth direction.

The charging device CH (for example, a scorotron charging device) includes a function of charging the photoreceptor 60 which rotates around the axis of the photoreceptor 60. The exposure device ID (for example, an LED head) includes a function of exposing the photoreceptor 60 which is charged by the charging device CH forms a latent image on the photoreceptor 60. In other words, the photoreceptor 60 is configured such that a latent image is formed by the photoreceptor 60 being charged by the charging device CH and exposed by the exposure device ID. Here, the photoreceptor 60 is an example of a latent image forming member. Note that, the exposure device ID is configured such that a latent image is formed on the photoreceptor 60 due to the exposure device ID causing an LED (not shown) to emit light according to the image data which is received from the control section 50 (described later).

Developing Device

The developing device 70 includes a function of developing the latent image of the photoreceptor 60 as the toner image G1 at a nip N1 (described later) using the developer G. As illustrated in FIG. 1, the developing device 70 is configured to include a first supply roll 72, a developing roll 74, a charging device 76, and a second supply roll 78. Here, the first supply roll 72 is an example of a first supply member, the developing roll 74 is an example of a developing member, and the second supply roll 78 is an example of a second supply member. Note that, the first supply roll 72, the developing roll 74, and the second supply roll 78 are cylindrical, and are disposed in a state in which the axes thereof line up with the axis of the photoreceptor 60.

First Supply Roll

The first supply roll 72 forms a nip N2 with the developing roll 74, and includes a function of supplying the developer G to the developing roll 74 while rotating around the axis of the first supply roll 72. Here, the nip N2 is an example of the second nip. The first supply roll 72 of the present exemplary embodiment is an anilox roll on the outer circumferential surface of which a regular uneven pattern (not shown) is formed. The first supply roll 72 is disposed in a state in which the portion of the bottom side thereof is immersed in the developer G which is stored in a container (not shown). The charging device (not shown) is disposed at a portion of the first supply roll 72 which is closer to the downstream side in the rotational direction than a portion of the bottom side of the first supply roll 72, closer to the upstream side than the nip N2, and which faces the outer circumferential surface. The first supply roll 72 is configured to transport the developer G to which the uneven pattern of the outer circumferential surface of the first supply roll 72 to the nip N2 and to supply the developer G to the developing roll 74 at the nip N2 while being driven by a drive source (not shown) to rotate around the axis. At this time, with regard to the developer G which is supplied from the first supply roll 72 to the developing roll 74, the toner T which forms the developer G is positively charged by the charging device. Note that, in the first supply roll 72 of the present exemplary embodiment, a positive voltage is applied to the developing roll 74 from a power source (not shown). When the first supply roll 72 supplies the developer G to the developing roll 74, a layer of the developer G with a film thickness of approximately 5 μm, for example, is formed on (the outer circumferential surface of) the developing roll 74 (refer to FIG. 2).

Developing Roll

The developing roll 74 forms the nip N1 with the photoreceptor 60, and includes a function of developing the latent image of the photoreceptor 60 as the toner image G1 using the developer G which is supplied from the first supply roll 72 while rotating around the axis of the developing roll 74. Here, the nip N1 is an example of a first nip. The developing roll 74 is configured be driven by a drive source (not shown) to rotate around the axis of the developing roll 74. Note that, in the developing roll 74 of the present exemplary embodiment, a positive voltage is applied to the developing roll 74 from a power source (not shown).

Charging Device

The charging device 76 (for example, a scorotron charging device) includes a function of positively charging the toner T in the developer G on the developing roll 74 which rotates around the axis of the developing roll 74. The charging device 76 of the present exemplary embodiment is, for example, a scorotron charging device, and is disposed to face the developing roll 74 closer to the upstream side in the rotational direction than the nip N1 in the developing roll 74 and closer to the downstream side than the nip N2 in a state in which the longitudinal direction of the charging device 76 is parallel to the axis of the photoreceptor 60. Note that, the toner T which is positively charged by the charging device 76 receives the influence of an electric field formed by the charging device 76 and moves from the charging device 76 side to the developing roll 74 side.

Second Supply Roll

The second supply roll 78 includes a function of supplying the liquid L to the developing roll 74. The second supply roll 78 faces the developing roll 74 closer to the upstream side in the rotational direction of the developing roll 74 than the nip N1 in the developing roll 74 and closer to the downstream side (closer to the downstream side than the portion facing the charging device 76) than the nip N2. Note that, the second supply roll 78 is separated from the developing roll 74.

The second supply roll 78 is a rubber roll, on the outer circumferential surface of which a random uneven pattern (not shown) is formed. The second supply roll 78 is disposed in a state in which the portion of the bottom side thereof is immersed in the liquid L which is stored in a container (not shown). The second supply roll 78 is configured be driven by a drive source (not shown) to rotate around the axis of the second supply roll 78 at a lower circumferential speed than the circumferential speed of the developing roll 74. The second supply roll 78 is configured to supply the liquid L to the developing roll 74 at the portion of the second supply roll 78 which faces the developing roll 74 by rotating around the axis of the second supply roll 78 while causing the liquid L which is adhered to the uneven pattern of the outer circumferential surface of the second supply roll 78 to contact with the developer G on the developing roll 74. Note that, when the second supply roll 78 supplies the liquid L to the developing roll 74, the liquid L which is supplied by the second supply roll 78 is added to the developer G which is supplied to the developing roll 74 by the first supply roll 72, and a layer of the developer G with a film thickness of approximately 8 μm, for example, is formed on (the outer circumferential surface of) the developing roll 74 (refer to FIG. 2).

Transfer Device

The transfer device 30 includes a function of transferring the toner image G1 which is developed on the photoreceptor 60 onto the medium P to form the toner image G1 on the medium P. As illustrated in FIG. 1, the transfer device 80 is configured to include a first roll 82 and a second roll 84. Here, the transfer device 80 is an example of a transfer unit.

The first roll 82 is cylindrical, and forms a nip N3 with the photoreceptor 60 in a state in which the axis of the first roll 82 is parallel to the axis of the photoreceptor 60. The first roll 82 is configured such that the toner image G1 which is developed on the photoreceptor 60 at the nip N3 is (primary) transferred to the first roll 82 while the first roll 82 is driven by a drive source (not shown) to rotate around the axis of the first roll 82. In the first roll. 82 of the present exemplary embodiment, a negative voltage is applied to the photoreceptor 60 from a power source (not shown). The second roll 84 includes a function of (secondary) transferring the toner image G1 which is transferred onto the first roll 82 onto the medium P. The second roll 84 is cylindrical, and forms a nip N4 with the first roll 82 in a state in which the axis of the second roll 84 is parallel to the axis of the first roll 82. The second roll 84 is configured to be driven to rotate with the rotation of the first roll 82 around the axis thereof. In the second roll 84 of the present exemplary embodiment, a negative voltage is applied to the first roll 82 from a power source (not shown). The transfer device 80 causes the toner image G1 which is developed on the photoreceptor 60 to be transferred to the first roll 82, and causes the second roll 84 to transfer the toner image G1 on the first roll 82 to the medium P which is transported to the nip N4 using the transport device 20.

Fixing Device

The fixing device 40 includes a function of fixing the toner T which forms the toner image G1 which is transferred onto the medium P by the transfer device 80 onto the medium P at a nip N5. As illustrated in FIG. 1, the fixing device 40 is configured to include a heating roll 42 and a pressure roll 44. Note that, the heating roll 42 and the pressure roll 44 form the nip N5 in a state in which the axes thereof are parallel to each other.

Control Section

The control section 50 includes a function of controlling the parts other than the control section 50 which configures the image forming apparatus 10.

The configuration of the image forming apparatus 10 is described above.

Operation

Next, description will be given of the image forming operation carried out by the image forming apparatus 10 of the present exemplary embodiment with reference to FIG. 1.

The control section 50 which receives the image data from an external device (not shown) causes the toner image forming member 30, the transport device 20, and the fixing device 40 to operate. Specifically, the control section 50 causes each drive source of the toner image forming member 30 to drive, causes the medium P to be transported by the transport device 20, and causes the heating roll 42 of the fixing device 40 to heat up.

In the developing device 70, the control section 50 causes the first supply roll 72 to rotate, and causes the developer G to be supplied to the developing roll 74. The control section 50 causes the charging device 76 to charge the toner T which forms the developer G on the developing roll 74, while causing the developing roll 74 to rotate. The control section 50 causes the second supply roll 78 to rotate to supply the liquid L onto the developing roll 74. The control section 50 causes the charging device CH to charge the photoreceptor 60, and causes the exposure device ID to form the latent image. The control, section 50 causes a voltage to be applied to the developing roll 74 from a power source (not shown), and causes the latent image of the photoreceptor 60 to be developed as the toner image G1 at the nip N1.

Next, the control section 50 causes a voltage to be applied to the first roll 82 from a power source (not shown), and causes the toner image G1 which is developed on the photoreceptor 60 to be transferred to the first roll 82. The control section 50 causes a voltage to be applied to the second roll 84 from a power source (not shown), and causes the toner image G1 which is transferred to the first roll 82 to be transferred to the medium P which passes through the nip N4.

Nest, the control section 50 causes the transport device 20 to transport the medium P onto which the toner image G1 is transferred to the nip N5, causes the fixing device 40 to heat and pinch the toner T which forms the toner image G1 of the medium P which passes through the nip N5 to cause the toner T to be fixed to the medium P (the image G2 is formed on the medium P). The image forming operation carried out by the image forming apparatus 10 of the present exemplary embodiment is completed by the medium P on which the image G2 is formed being transported by the transport device 20 and wound by the winding section (not shown).

The operations of the image forming apparatus 10 are described above.

Mechanisms

Next, description of the mechanisms of the present exemplary embodiment will be given in comparison to the comparative embodiment described below, with reference to the drawings. Note that, when a part or the like which is used in the present exemplary embodiment is used in the comparative embodiment, the reference numeral, the name, and the like of the part will be used without change.

Figure 3:
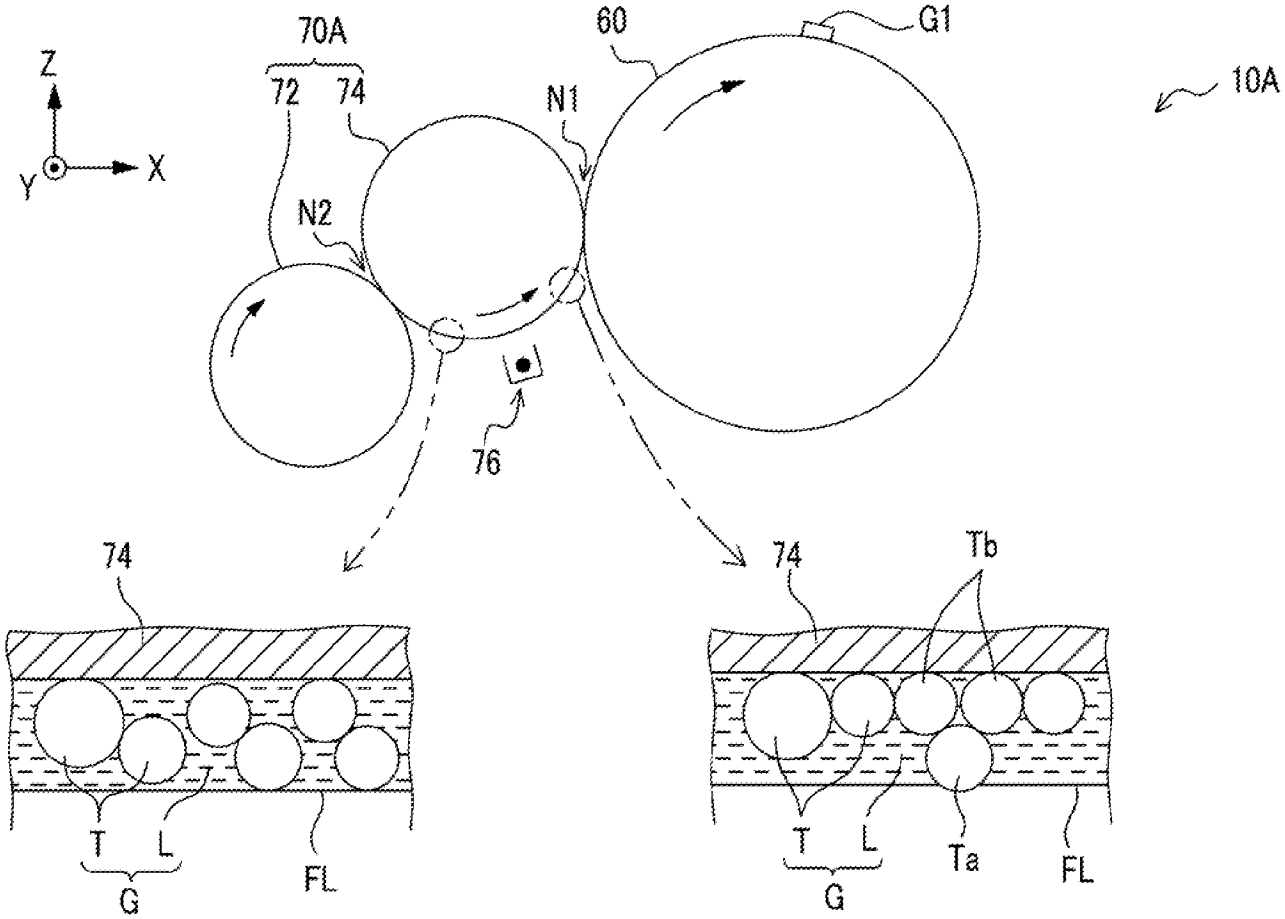
FIG. 3 is a schematic diagram (a front diagram) of a portion of a toner image forming member which configures the image forming apparatus of a comparative embodiment.

As illustrated in FIG. 3, a developing device 70A of the comparative embodiment is not provided with the second supply roll 78 which configures the developing device 70 of the present exemplary embodiment. Except for the point described above, the developing device 70A of the comparative embodiment is configured in the same manner as the developing device 70 of the present exemplary embodiment. An image forming apparatus 10A of the comparative embodiment is configured in the same manner as the image forming apparatus 10 of the present exemplary embodiment except in that the image forming apparatus 10A is provided with the developing device 70A of the comparative embodiment instead of the developing device 70 of the present exemplary embodiment.

Figure 4:
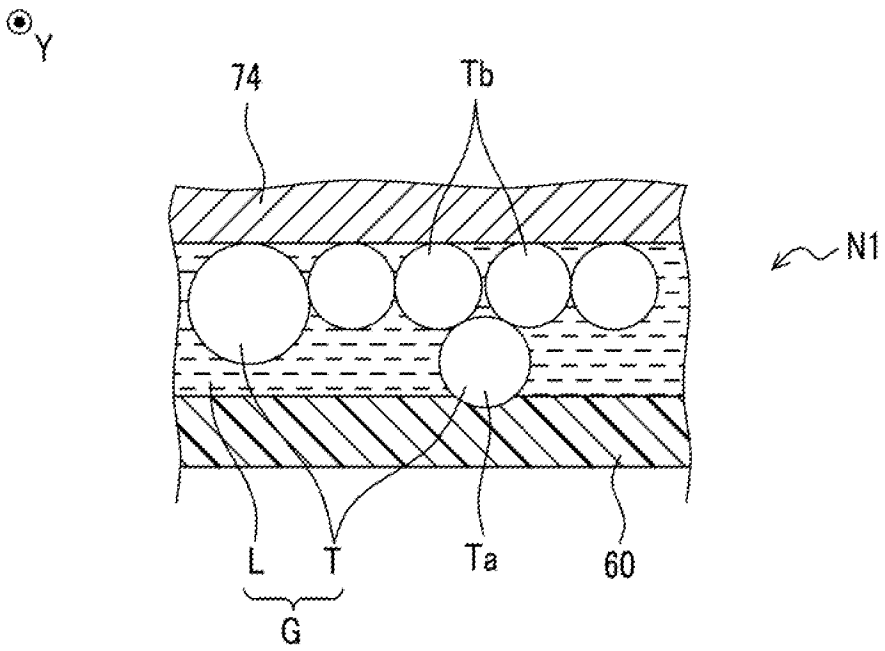
FIG. 4 is a schematic diagram illustrating a state of a developer at a nip between a developing roll and a photoreceptor in the toner image forming member of the comparative embodiment.

In the case of the developing device 70A of the comparative embodiment, since the toner T in the developer G on the developing roll 74 which is supplied by the first supply roll 72 is rendered positive, the toner T is apt to move to the outer circumferential surface of the developing roll 74. At this time, there is a case in which a portion of toner particles Ta overlap other toner particles Tb in the thickness direction of the layer of the developer G, and reach the nip N1 (refer to FIG. 4) in a state in which the other toner particles Tb are pushed out from a liquid surface FL of the layer of the developer G (refer to FIG. 3). In the nip N1, when the toner particles Ta contact with a region (a region which is not exposed by the exposure device ID) of the photoreceptor 60 to which the toner particles would not ordinarily adhere, there is a case in which the toner particles Ta are adhered to the region of the photoreceptor 60 and fogging is occurred. Here, the term "fogging" refers to toner particles adhering to a region of the photoreceptor 60 which is not exposed. Note that, when the toner particles Ta adhere to the region on the photoreceptor 60, the toner image G1 is formed on the photoreceptor 60 in a state in which fogging is occurred. When the toner particles Ta which are adhered to the photoreceptor 60 are transferred and fixed to the medium P, the image G2 is formed on the medium P in a state in which fogging is occurred.

In particular, in the case of the developing device 70A of the comparative embodiment, the charging device 76 is disposed to face the developing roll 74 closer to the upstream side in the rotational direction of the developing roll 74 than the nip N1 in the developing roll 74 and closer to the downstream side than the nip N2, and positively charges the toner T. In the case of the developing device 70A of the comparative embodiment, due to the toner T being positively charged by the charging device 76, the toner particles easily overlap each other in the thickness direction of the layer of the developer G in the developing roll 74, and, as a result, it is hypothesized that the occurrence of fogging will become remarkable.

In contrast, as illustrated in FIGS. 1 and 2, the developing device 70 of the present exemplary embodiment is provided with the second supply roll 78, which is closer to the upstream side in the rotational direction of the developing roll 74 than the nip N1 in the developing roll 74 and closer to the downstream side than the nip N2, and supplies the liquid L to the developing roll 74. When the liquid L is supplied to the developing roll 74 by the second supply roll 78, the thickness of the layer of the developer G on the developing roll 74 is increased. Therefore, the toner particles in the developer G on the developing roll 74 are not easily pushed out from the liquid surface FL of the layer of the developer G.

Therefore, according to the developing device 70 of the present exemplary embodiment, the occurrence of fogging on the photoreceptor 60 is suppressed in comparison to a developing device which does not supply the liquid L to the developing roll 74 at a position closer to the upstream side in the rotational direction of the developing roll 74 than the nip N1 in the developing roll 74 and closer to the downstream side than the nip N2. In addition, in the image forming apparatus 10 of the present exemplary embodiment, image forming faults caused by fogging are suppressed in comparison to an image forming apparatus provided with the developing device described above.

Second Exemplary Embodiment

Figure 5:
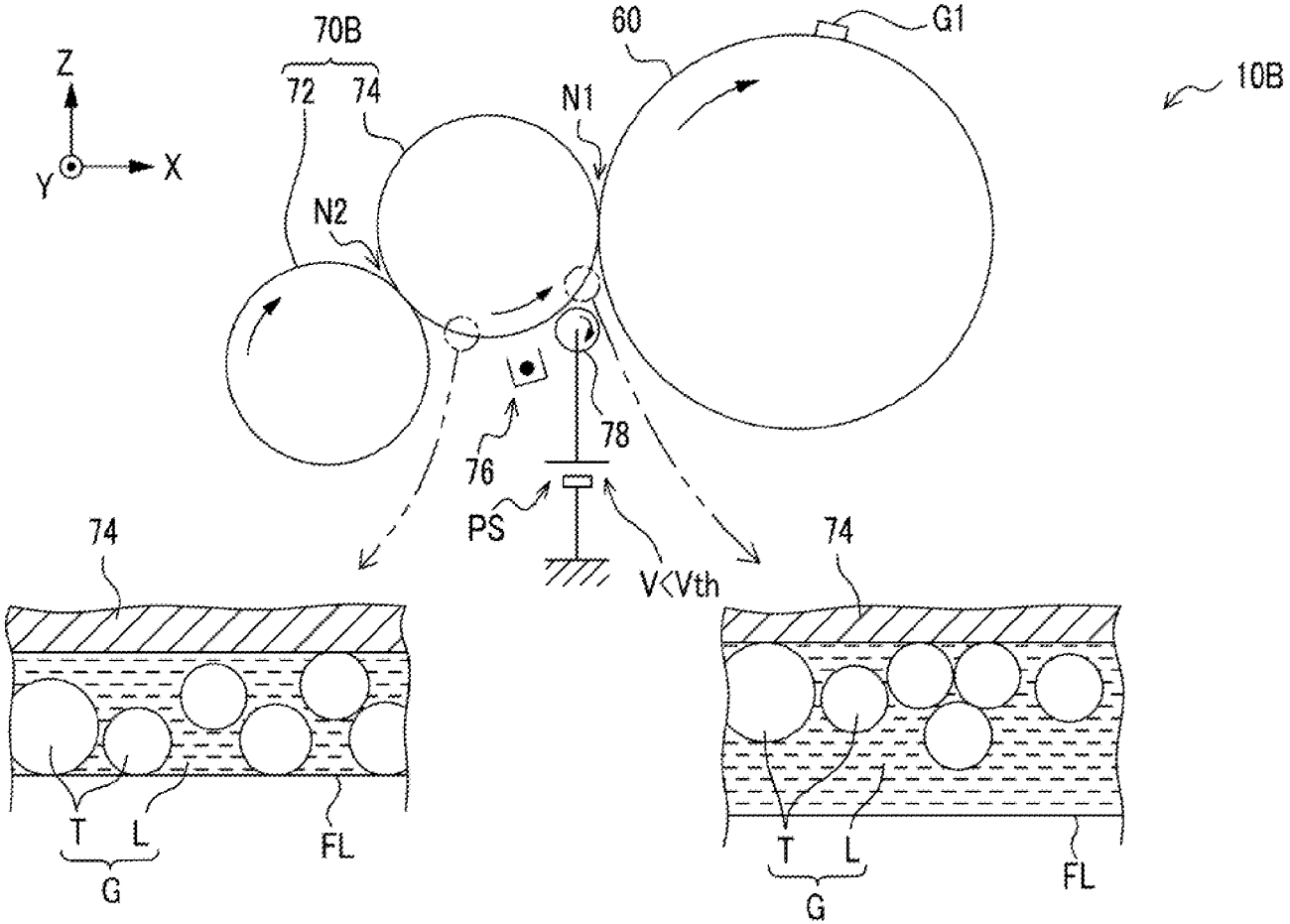
FIG. 5 is a schematic diagram (a front diagram) of a portion of a toner image forming member which configures an image forming apparatus of a second exemplary embodiment.

Next, description will be given of the second exemplary embodiment with reference to FIG. 5. When a part or the like which is used in the first exemplary embodiment is used in the present exemplary embodiment, the reference numeral, the name, and the like of the part will be used without change.

Configuration

A developing device 70B of the present exemplary embodiment is provided with a power supply PS which applies, to the second supply roll 78, a positive voltage with respect to the developing roll 74. In the case of the present exemplary embodiment, the power source PS is configured to apply a voltage to the second supply roll 78 and the developing roll 74, the voltage being less than a discharge initiation voltage Vth. According to the configuration described above, the developing device 70B of the present exemplary embodiment is configured to form an electric field which causes the toner T in the developer G on the developing roll 74 to move from the second supply roll 78 side to the developing roll 74 side. In other words, the second supply roll 78 of the present exemplary embodiment includes the function of the first exemplary embodiment (the function of supplying the liquid L to the developing roll 74), and a function of forming an electric field which causes the toner T in the developer G on the developing roll 74 to move from the second supply roll 78 side to the developing roll 74 side. In the case of the present exemplary embodiment, the discharge initiation voltage Vth is set to +600 V, for example. Here, the term "the discharge initiation voltage Vth" refer to the voltage at which corona discharge is generated between the second supply roll 78 and the developing roll 74. Except for the point described above, the developing device 70B of the present exemplary embodiment is configured in the same manner as the developing device 70 of the first exemplary embodiment. An image forming apparatus 10B of the present exemplary embodiment is configured in the same manner as the image forming apparatus 10 of the first exemplary embodiment except in that the image forming apparatus 10B is provided with the developing device 70B of the present exemplary embodiment instead of the developing device 70 of the first exemplary embodiment.

Operation

The image forming operation of the present exemplary embodiment is the same as the case of the first exemplary embodiment except in that the liquid L is supplied to the developing roll 74 by the second supply roll 78 while the power source PS applies a voltage below the discharge initiation voltage Vth to the second supply roll 78.

Mechanisms

In the case of the developing device 70 of the first exemplary embodiment, when the liquid L is supplied to the developing roll 74 by the second supply roll 78, there is a case in which the alignment of the toner particles which are adhered to the outer circumferential surface of the developing roll 74 is disturbed. In addition, when the latent image of the photoreceptor 60 is developed as the toner image G1, there is a concern that dark and light patches will be occurred in the toner image G1.

In contrast, in the case of the developing device 70B of the present exemplary embodiment, the second supply roll 78 supplies the liquid L to the developing roll 74, and forms an electric field which causes the toner T in the developer G to move from the second supply roll 78 side to the developing roll 74 side. Therefore, in the developing device 70B of the present exemplary embodiment, the alignment of the toner particles which are adhered to the outer circumferential surface of the developing roll 74 is not easily disturbed in comparison to in the developing device 70 of the first exemplary embodiment. Even if the alignment of the toner particles is disturbed and the toner particle separate from the outer circumferential surface of the developing roll 74 as the second supply roll 78 supplies the liquid L to the developing roll 74, the developing device 70B of the present exemplary embodiment may cause the toner separated particles to move the outer circumferential surface using an electric field.

Therefore, according to the developing device 70B of the present exemplary embodiment, the second supply roll 78 may cause the toner T in the developer G which is supplied to the developing roll 74 by the second supply roll 78 to move from the second supply roll 78 side to the developing roll 74 side. In addition, according to the image forming apparatus 10B of the present exemplary embodiment, image forming faults caused by dark and light patches in the toner image G1 are suppressed. Note that, the other mechanisms of the present exemplary embodiment are the same as the mechanisms of the first exemplary embodiment.

Third Exemplary Embodiment

Figure 6:
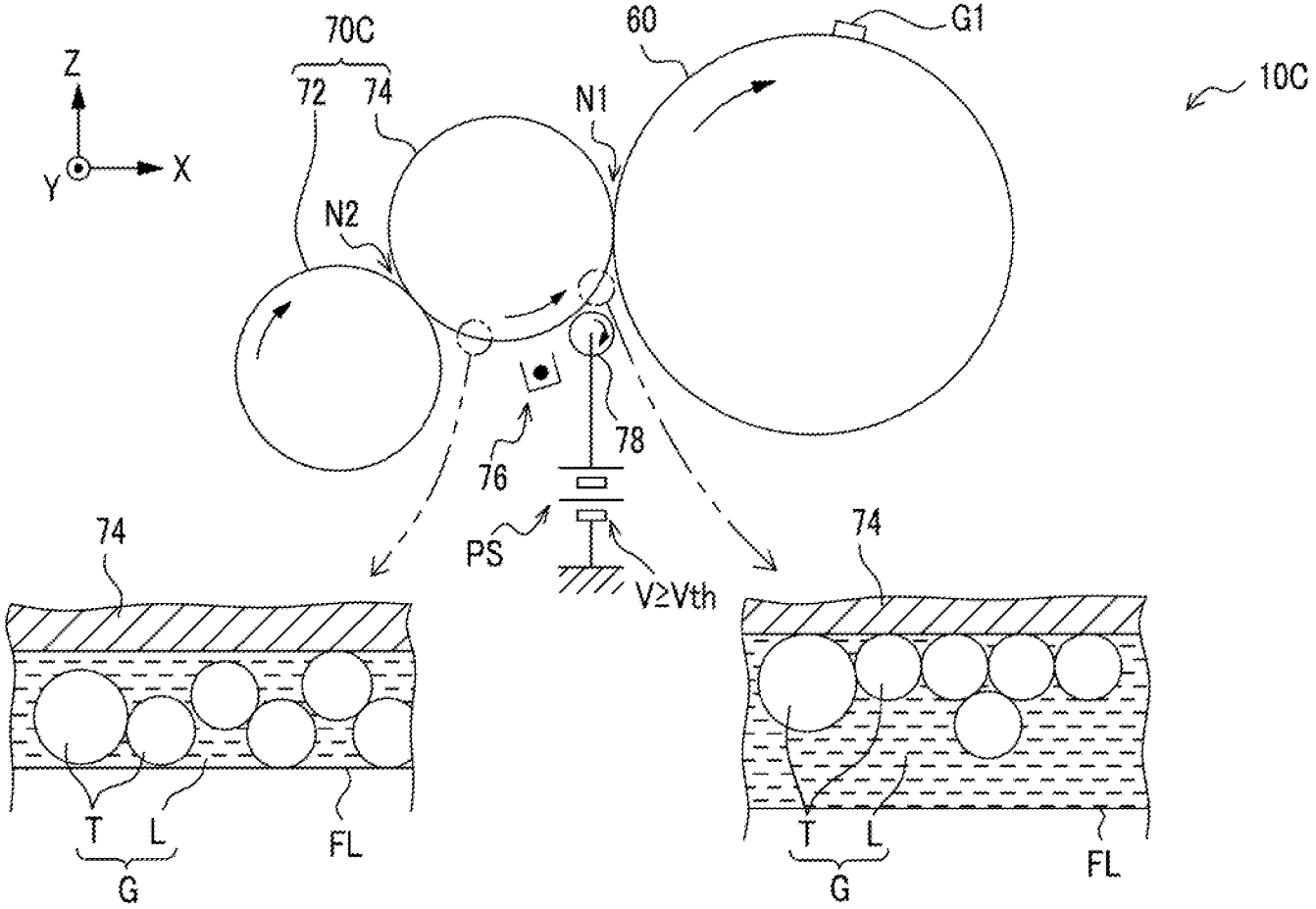
FIG. 6 is a schematic diagram (a front diagram) of a portion of a toner image forming member which configures an image forming apparatus of a third exemplary embodiment.

Next, description will be given of the third exemplary embodiment with reference to FIG. 6. When a part or the like which is used in the first and second exemplary embodiments is used in the present exemplary embodiment, the reference numeral, the name, and the like of the part will be used without change.

Configuration

A developing device 70C of the present exemplary embodiment is provided with the power supply PS which applies, to the second supply roll 78, a positive voltage with respect to the developing roll 74 in the same manner as the developing device 70B (refer to FIG. 5) of the second exemplary embodiment. However, in the case of the present exemplary embodiment, unlike in the case of the second exemplary embodiment, the power source PS is configured to apply a voltage to the second supply roll 78 and the developing roll 74, the voltage being greater than or equal to the discharge initiation voltage Vth (however, the applied voltage is less than a voltage at which breakdown occurs between the second supply roll 78 and the developing roll 74). In other words, the second supply roll 78 of the present exemplary embodiment includes the functions of the second exemplary embodiment (the function of supplying the liquid L to the developing roll 74 and the function of forming an electric field which causes the toner T in the developer G on the developing roll 74 to move from the second supply roll 78 side to the developing roll 74 side) in addition to a function of more positively charging the toner T. Except for the point described above (the point in which the power source PS applies a voltage to the second supply roll 78), the developing device 70C of the present exemplary embodiment is configured in the same manner as the developing device 70B of the second exemplary embodiment. Except for the point described above, an image forming apparatus 10C of the present exemplary embodiment is configured in the same manner as the image forming apparatus 10B of the second exemplary embodiment.

Operation

The image forming operation of the present exemplary embodiment is the same as the case of the second exemplary embodiment except in that the liquid L is supplied to the developing roll 74 by the second supply roll 78 while the power source PS applies a voltage greater than or equal to the discharge initiation voltage Vth to the second supply roll 78.

Mechanisms

In the case of the developing device 70B of the second exemplary embodiment, the corona discharge is not generated between the second supply roll 78 and the developing roll 74.

In contrast, in the case of the developing device 70B of the present exemplary embodiment, since a voltage greater than or equal to the discharge initiation voltage is applied to the second supply roll 78, the second supply roll 78 generates the corona discharge in relation to the developing roll 74. Therefore, the toner T in the developer G on the developing roll 74 is more positively charged by the attachment of positive ions which are generated by the corona discharge, and the more positively charged toner T moves easily from the second supply roll 78 side to the developing roll 74 side.

Therefore, according to the developing device 70C of the present exemplary embodiment, the movement of the toner T in the developer G from the second supply roll 78 side to the developing roll 74 side may be promoted in comparison to a developing device which forms an electric field which causes the toner T in the developer G which is supplied to the developing roll 74 to move from the second supply roll 78 side to the developing roll 74 side due to the voltage which is less than the discharge initiation voltage Vth being applied to the developing roll 74. In addition, in the image forming apparatus 10C of the present exemplary embodiment, image forming faults caused by dark and light patches in the toner image G1 are suppressed in comparison to an image forming apparatus provided with the developing device described above which forms the electric field due to the voltage which is less than the discharge initiation voltage Vth being applied to the developing roll 74. Note that, the other mechanisms of the present exemplary embodiment are the same as the mechanisms of the first exemplary embodiment.

Fourth Exemplary Embodiment

Figure 7:
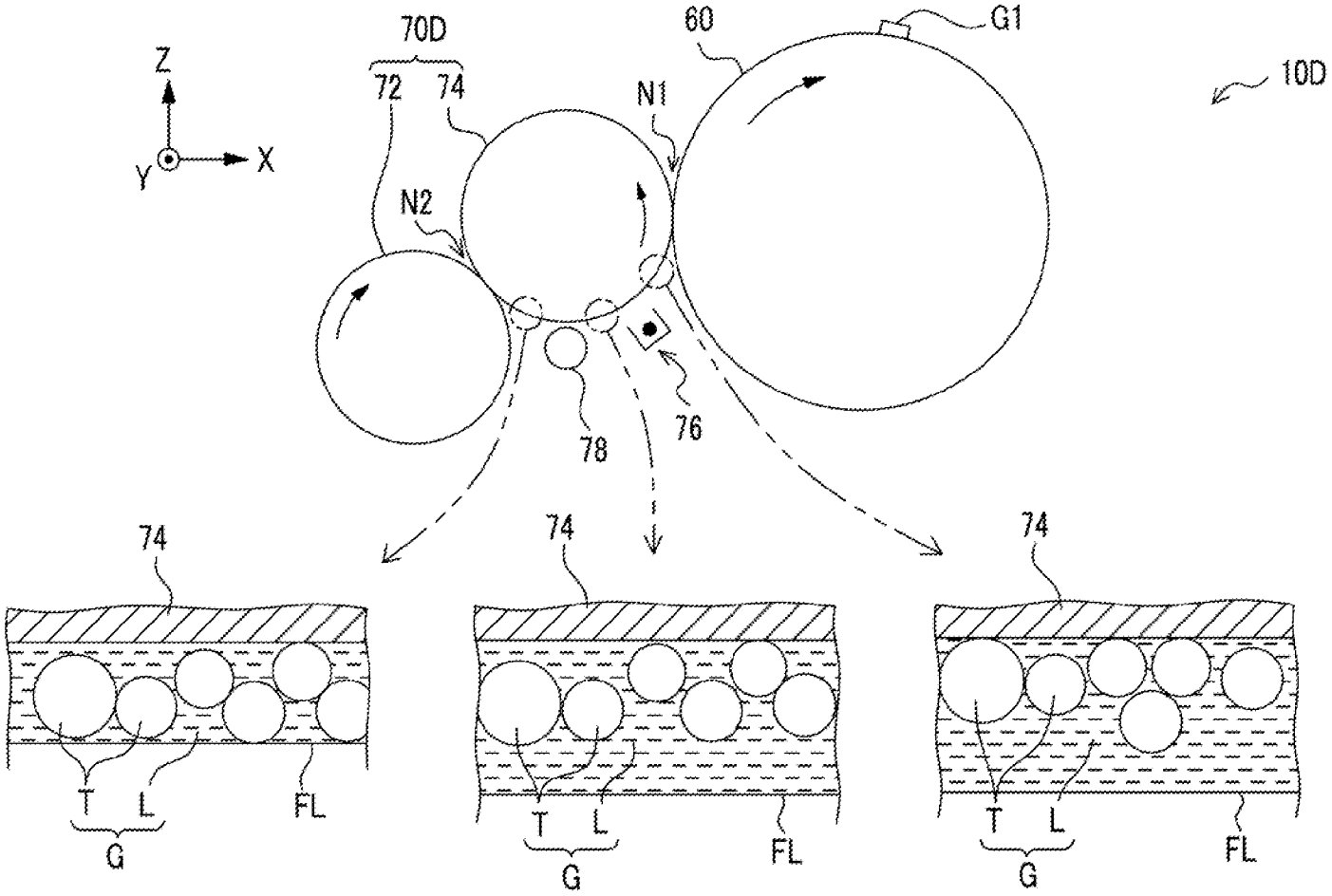
FIG. 7 is a schematic diagram (a front diagram) of a portion of a toner image forming member which configures an image forming apparatus of a fourth exemplary embodiment.

Next, description will be given of the fourth exemplary embodiment with reference to FIG. 7. When a part or the like which is used in the first to third exemplary embodiments is used in the present exemplary embodiment, the reference numeral, the name, and the like of the part will be used without change.

Configuration

In relation to the developing device 70 (refer to FIGS. 1 and 2) of the first exemplary embodiment, a developing device 70D of the present exemplary embodiment has the opposite relationship to that of the disposition of the charging device 76 and the second supply roll 78 in relation to the developing roll 74. In other words, the second supply roll 78 of the present exemplary embodiment faces the developing roll 74 closer to the upstream side in the rotational direction of the developing roll 74 than the position of the charging device 76 facing the developing roll 74 and closer to the downstream side than the nip N2 in a state of being separated from the developing roll 74. In other words, the charging device 76 of the present exemplary embodiment faces the developing roll 74 closer to the upstream side in the rotational direction of the developing roll 74 than the nip N1 in the developing roll 74 and closer to the downstream side than the position at which the second supply roll 78 faces the developing roll 74. The charging device 76 of the present exemplary embodiment is configured to charge the toner T in the developer G which is supplied to the developing roll 74 more positively, and to form an electric field which causes the toner T to move from the charging device 76 side to the developing roll 74 side. Here, the charging device 76 of the present exemplary embodiment is an example of an electric field forming member. Except for the point described above, the developing device 700D of the present exemplary embodiment is configured in the same manner as the developing device 70 of the first exemplary embodiment. An image forming apparatus 10D of the present exemplary embodiment is configured in the same manner as the image forming apparatus 10 of the first exemplary embodiment except in that the image forming apparatus 10D is provided with the developing device 70D of the present exemplary embodiment instead of the developing device 70 of the first exemplary embodiment.

Operation

The image forming operation of the present exemplary embodiment is the same as the case of the first exemplary embodiment except in that, after the liquid L is supplied to the developing roll 74 by the second supply roll 78, the toner T which forms the developer G on the developing roll 74 is charged by the charging device 76.

Mechanisms

In the cases of the first to the third exemplary embodiments described earlier, during a period from when the liquid L on the developing roll 74 is supplied to when the liquid L reaches the nip N1, the toner T which forms the developer G on the developing roll 74 is not more positively charged.

In contrast, in the case of the developing device 70D of the present exemplary embodiment, after the liquid L is supplied to the developing roll 74 by the second supply roll 78, the toner T in the developer G which is supplied to the developing roll 74 is charged by the charging device 76.

Therefore, according to the developing device 70D of the present exemplary embodiment, the toner T in the developer G may be caused to move from the liquid surface FL side of the developer G to the outer circumferential surface side of the developing roll 74 in comparison to a developing device which does not charge the toner T in the developer G after the liquid L is supplied by the second supply roll 78. In addition, in the image forming apparatus 10D of the present exemplary embodiment, image forming faults caused by dark and light patches in the toner image G are suppressed in comparison to an image forming apparatus provided with a developing device which does not charge the toner T in the developer G after the liquid L is supplied by the second supply roll 78. Note that, the other mechanisms of the present exemplary embodiment are the same as the mechanisms of the first exemplary embodiment.

Fifth Exemplary Embodiment

Next, description will be given of the fifth exemplary embodiment with reference to FIG. 8. When a part or the like which is used in the first to fourth exemplary embodiments is used in the present exemplary embodiment, the reference numeral, the name, and the like of the part will be used without change.

Configuration

Figure 8:
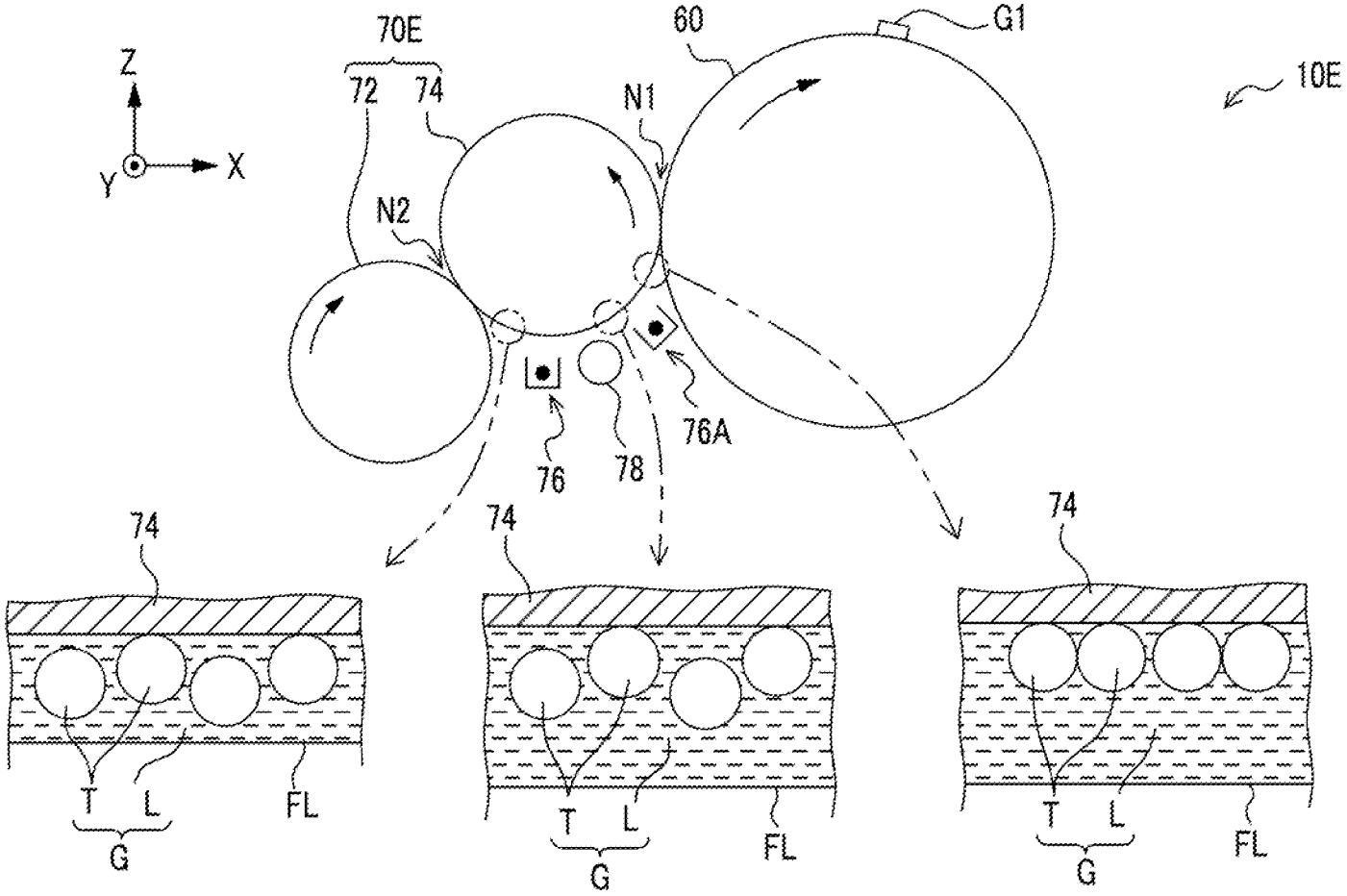
FIG. 8 is a schematic diagram (a front diagram) of a portion of a toner image forming member which configures an image forming apparatus of a fifth exemplary embodiment.

As illustrated in FIG. 8, a developing device 70E of the present exemplary embodiment differs from the developing device 70 of the first exemplary embodiment in that the developing device 70E is provided with a charging device 76A of the same configuration as the charging device 76. Here, the charging device 76A which configures the developing device 70E of the present exemplary embodiment is an example of the electric field forming member. Specifically, the charging device 76A faces the developing roll 74 closer to the downstream side in the rotational direction of the developing roll 74 than the position at which the second supply roll 78 faces the developing roll 74 in the developing roll 74 and closer to the upstream side than the nip N1. The charging device 76A is configured to charge the toner T in the developer G which is supplied to the developing roll 74 more positively, and to form an electric field which causes the toner T to move from the charging device 76A side to the developing roll 74 side. Note that, in the developing device 70E, the charging device 76 and the second supply roll 78 facing the developing roll 74 are disposed shifted to the upstream side in the rotational direction of the developing roll 74 in relation to the developing device 70 of the first exemplary embodiment. Except for the point described above, the developing device 70E of the present exemplary embodiment is configured in the same manner as the developing device 70 of the first exemplary embodiment. Except for the point in which an image forming apparatus 10E of the present exemplary embodiment is provided with the developing device 70E instead of the developing device 70, the configuration of the image forming apparatus 10E of the present exemplary embodiment is the same as that of the image forming apparatus 10 of the first exemplary embodiment.

Operation

The image forming operation of the present exemplary embodiment is the same as the case of the first exemplary embodiment except in that, after the liquid L is supplied to the developing roll 74 by the second supply roll 78, the toner T which forms the developer G on the developing roll 74 is charged by the charging device 76A.

Mechanisms

Note that, the mechanisms of the present exemplary embodiment are the same as the mechanisms of the first and the fourth exemplary embodiments.

EXAMPLES

Next, description will be given of the examples and the comparative example with reference to the drawings. Note that, when a part or the like which is used in the first to fifth exemplary embodiments described earlier is used in each example and comparative example, the reference numeral of the part and the like will be used without change.

Outline

The image G2 is formed on the medium P and the evaluation test of the image quality of the image G2 is performed using the image forming apparatuses provided with the developing devices of the examples described below and the image forming apparatus provided with the developing device of the comparative example. In the present evaluation test, the fogging and the perceived roughness are evaluated using the image G2 which is formed by each of the image forming apparatuses described above.

Description of Image Forming Apparatus

The image forming apparatuses of the examples are set to the following three (the image forming apparatuses of the first to the third example), and the image forming apparatus of the comparative example is set to the following one.

Image Forming Apparatuses of Examples

The image forming apparatus of the first example is the image forming apparatus 10 which is provided with the developing device 70 of the first exemplary embodiment described earlier (refer to FIGS. 1 and 2). The image forming apparatus of the second example is the image forming apparatus 10E which is provided with the developing device 70E of the fifth exemplary embodiment described earlier (refer to FIG. 8). The image forming apparatus of the third example is the image forming apparatus 10B which is provided with the developing device 70B of the second exemplary embodiment described earlier (refer to FIG. 5).

Image Forming Apparatus of Comparative Example

The image forming apparatus of the comparative example is set to the image forming apparatus 10A which is provided with the developing device 70A of the comparative embodiment described earlier (refer to FIG. 3).

Test Method

Image Forming Method

In the present test, each of the image forming apparatuses 10, 10E, 10B, and 10A is operated using the conditions (the common conditions) illustrated in the table of FIG. 9. Each of the image forming apparatuses 10, 10E, 10B, and 10A is operated using the conditions (the unique conditions) illustrated in the table of FIG. 10. Two types of the image G2 for performing each evaluation (described later) are formed by each of the image forming apparatuses 10, 10E, 10B, and 10A.

Evaluation of Fogging

In the evaluation test of the fogging, a grid pattern (square portions which form the 1.00% solid toner image G1 and square portions which form the 0% toner image G1 (hereinafter referred to as 0% portions)) is formed on the photoreceptor 60 by each of the image forming apparatuses 10, 10E, 10B, and 10A.

The evaluation of the fogging is performed based on the following evaluation criteria. When an evaluator observes the image G2 using a loupe, if the evaluator barely visually recognizes that a tiny amount of the toner T is fixed to the 0% portion of the medium P, the evaluation is A (pass). When the evaluator observes the image G2 by naked eye, if the evaluator barely visually recognizes that the color of the toner T is adhered to the 0% portion of the medium P, the evaluation is B (pass). When the evaluator observes the image G2 by naked eye, if the evaluator visually recognizes that the color of the toner T is adhered to the 0% portion of the medium P, the evaluation is C (fail).

Note that, the case of A (pass) corresponds to 0.2 or less in the fogging grade (described later, refer to FIG. 12), the case of B (pass) corresponds to between 0.2 and 0.5 in the fogging grade, and C (fail) corresponds to 0.5 or greater in the fogging grade. Here, the term "the fogging grade" refers to the ratio of an adherence area of the fogging toner to a unit area in the 0% portion of the medium P. Note that, the test results of the fogging grade will be described later.

Evaluation of Perceived Roughness

In the evaluation test of the perceived roughness, for example, the image G2 having a solid pattern of plural image density halftones is formed on the medium P by each of the image forming apparatuses 10, 10E, 10B, and 10A. The evaluator performs a sensory evaluation by naked eye of a criteria sample of the image G2 and each of the images G2 that is actually formed based on the following evaluation criteria. When the evaluator determines that the halftone is uniform (no roughness is perceived) as a result of evaluating the image G2, the evaluation is pass (A). When the evaluator determines that the halftone is slightly non-uniform and that dots are slightly perceivable (a slight roughness is perceived) as a result of evaluating the image G2, the evaluation is pass (B). When the evaluator determines that the halftone is non-uniform and that dots are perceivable (roughness is perceived) as a result of evaluating the image G2, the evaluation is fail (C).

Test Results

FIG. 11 denotes the results of the image quality evaluation of each of the image forming apparatuses 10, 10E, 10B, and 10A. In the case of the image forming apparatus 10A of the comparative example, the evaluation of the fogging and the evaluation of the perceived roughness are both fail (C). In contrast, in the cases of the image forming apparatuses 10, 10E, and 10B of the first to the third examples, in all cases, the evaluation of the fogging and the evaluation of the perceived roughness are pass (B) or pass (A).

Observations

Observations Based on Evaluation Results of First to Third Examples and Comparative Example According to the table of FIG. 1I, the cases of the image forming apparatuses 10, 10E, and 10B of the first to the third examples are evaluated highly in the evaluation of the fogging in comparison to the case of the image forming apparatus 10A of the comparative example. It is hypothesized that this is because, as described in the mechanisms of each of the exemplary embodiments, the occurrence of fogging in the photoreceptor 60 is suppressed in the developing devices 70, 70E, and 70B of the first to the third examples in comparison to the developing device 70A of the comparative example which is a developing device which does not supply the liquid L to the developing roll 74 at a position closer to the upstream side in the rotational direction of the developing roll 74 than the nip N1 in the developing roll 74 and closer to the downstream side than the nip N2.

According to the table of FIG. 11, the cases of the image forming apparatuses 10, 10E, and 10B of the first to the third examples are evaluated highly in the evaluation of the roughness in comparison to the case of the image forming apparatus 10A of the comparative example. Of these evaluation results, with regard to the image forming apparatuses 10E and 10B of the second and the third examples, it is hypothesized that this is because the image forming faults caused by dark and light patches in the toner image G1 are suppressed in comparison to the image forming apparatus 10A which is provided with the developing device 70A of the comparative example, as described in the mechanisms of the second and fifth exemplary embodiments.

Observations Based on Evaluation Results of Second Example and First Example

According to the table of FIG. 11, the case of the image forming apparatuses 10E of the second example is evaluated highly in the evaluation of the fogging in comparison to the case of the image forming apparatus 10 of the first example. It is hypothesized that this is because, unlike the developing device 70 of the first example, the developing device 70E of the second example is provided with the charging device 76A which faces the developing roll 74 closer to the downstream side in the rotational direction of the developing roll 74 than the position at which the second supply roll 78 faces the developing roll 74 in the developing roll 74 and closer to the upstream side than the nip N1. Specifically, in the case of the developing device 70E of the second example, after the liquid L is supplied to the developing roll 74 by the second supply roll 78, the toner T which configures the developer G on the developing roll 74 is charged by the charging device 76A. Therefore, in the developing device 70E of the second example, it is hypothesized that this is because the alignment of the toner particles which are adhered to the outer circumferential surface of the developing roll 74 is not easily disturbed in comparison to the developing device 70 of the first example. In other words, the second example exhibits the mechanisms of the fourth exemplary embodiment described earlier.

Observations Based on Evaluation Results of Third Example and First Example

According to the table of FIG. 11, the case of the image forming apparatuses 10B of the third example is evaluated highly in the evaluation of the fogging in comparison to the case of the image forming apparatus 10 of the first example. It is hypothesized that this is because, as described in the mechanisms of the second exemplary embodiment, in the developing device 70B of the third example, the movement of the toner T in the developer G on the developing roll 74 from the developing roll 74 side to the second supply roll 78 side during the supply of the liquid L by the second supply roll 78 is suppressed in comparison to the image forming apparatus 10 which is provided with the developing device 70 of the first example.

According to the table of FIG. 11, the case of the image forming apparatuses 10B of the third example is evaluated highly in the evaluation of the roughness in comparison to the case of the image forming apparatus 10 of the first example. As described in the mechanisms of the second exemplary embodiment, with regard to the image forming apparatus 10B of the third example, it is hypothesized that this is because the image forming faults caused by dark and light patches in the toner image G1 are suppressed in comparison to the image forming apparatus 10 which is provided with the developing device 70 of the first example.

Figure 12:
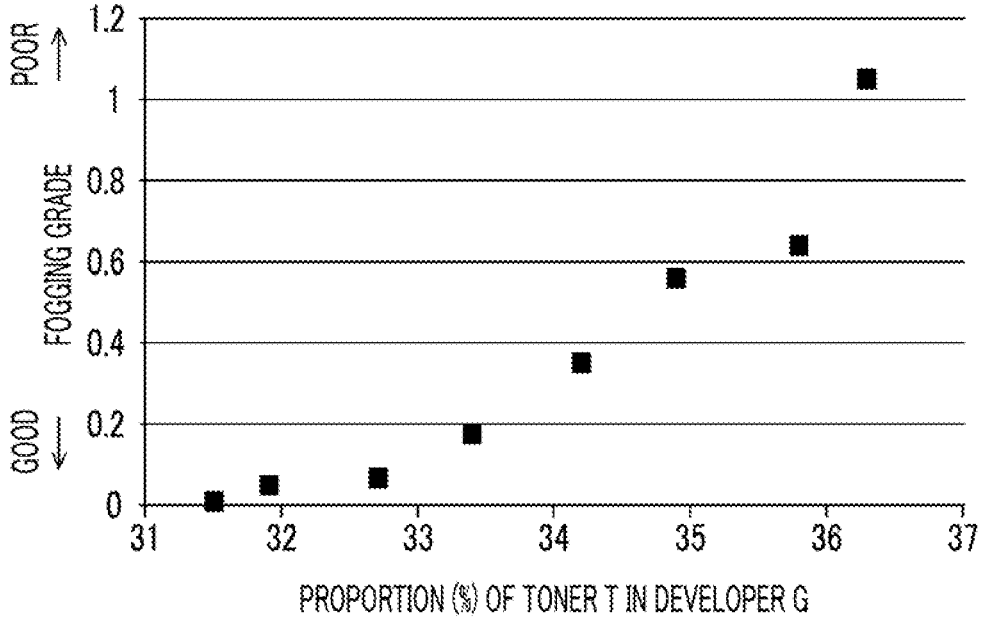
FIG. 12 is a graph illustrating the relationship between the proportion of toner in the developer and the degree of fogging.

Regarding Relationship Between Fogging and Proportion % of Toner T in Developer G Note that, the graph of FIG. 12 is a graph illustrating a test investigating the relationship between the fogging and the proportion of the toner T in the developer G using the image forming apparatus 10. According to the graph of FIG. 12, it may be understood that the lower the proportion of the toner T in the developer G, the more favorable the fogging grade. Here, to supplement the previously described tests, the case of the comparative example has a fogging grade of approximately 0.8. In the case of the comparative example, since the liquid L is not supplied to the developing roll 74 by the second supply roll 78, it is hypothesized that the fogging grade corresponds to the proportion of the toner T in the developer G which is supplied to the developing roll 74 by the first supply roll 72. In contrast, in the cases of the first to the third examples, the fogging grade is 0.4 or less. In the cases of the first to the third examples, it is hypothesized that, as a result of the liquid L which is supplied to the developing roll 74 by the second supply roll 78 being added to the developer G3 which is supplied to the developing roll 74 by the first supply roll 72, the proportion of the toner T in the developer G is reduced, and the fogging grade corresponds to the proportion of the toner T in the developer G.

Note that, as in the developing device 70A of the comparative example, even if the developing device 70A is not provided with the second supply roll 78, if the proportion of the toner T in the developer G which is supplied to the developing roll 74 by the first supply roll 72 is lowered to approximately 34% or less, it is considered that the occurrence of the fogging may be suppressed even in the developing device 70A of the comparative example. However, there is a tendency in that, the lower the proportion of the toner T in the developer G, the more the viscosity of the developer is reduced. Therefore, when the developer G in which the proportion of the toner T is lowered is used in the developing device 70A of the comparative example, a different problem arises in that the amount of the developer G which may be supplied to the developing roll 74 by the first supply roll 72 is insufficient. From this point, as described in the first to fifth exemplary embodiments, performing a developing process to the photoreceptor 60 after supplying the liquid to the developing roll 74 and reducing the proportion of the toner T in the developer G on the developing roll 74 is valid, even in comparison to a system in which the developer G with a reduced proportion of the toner T is directly supplied to the developing roll 74.

Specific exemplary embodiments of the invention are described above in detail; however, the invention is not limited to the exemplary embodiments described earlier, and other exemplary embodiments may be adopted within the scope of the technical idea of the invention.

For example, in the exemplary embodiments, the liquid L contained in the developer G is described to be a non-volatile oil, for example. However, if the developer G which is used is a liquid developer, the liquid contained in the developer G may not be a non-volatile oil. For example, the liquid contained in the developer G may be a volatile liquid.

In the description of the exemplary embodiments, the liquid which is supplied to the developing roll 74 by the second supply roll 78 is set to the liquid L which is contained in the developer G. However, the liquid which is supplied by the second supply roll 78 may be a different liquid from the liquid L. For example, the liquid which is contained in the developer G which is supplied by the first supply roll 72 and the liquid which is supplied by the second supply roll 78 may be set to be different non-volatile liquids (silicon oil in the first supply roll 72, and paraffin oil in the second supply roll 78). The liquid which is contained in the developer G which is supplied by the first supply roll 72 and the liquid which is supplied by the second supply roll 78 may be set to be different volatile liquids (a naphthene-based solvent in the first supply roll 72, and a normal heptane in the second supply roll 78). The liquid which is contained in the developer G which is supplied by the first supply roll 72 or the second supply roll 78 may be set to be a non-volatile liquid (for example, silicon oil), and the liquid which is supplied by the second supply roll 78 or the first supply roll 72 may be set to be a volatile liquid (for example, a naphthene-based solvent).

The toner image forming member 30 of each of the exemplary embodiments is described as being configured to include the first roll 82. However, the toner image forming member 30 may form a nip between the second roll 84 and the photoreceptor 60, and transfer the toner image G1 which is developed on the photoreceptor 60 to the medium P which is transported to the nip, without being provided with the first roll 82. Even in this modification example, the second roll 84 is an example of the transfer unit.

In the description of the exemplary embodiments, the second supply member is cylindrical and rotates around an axis, the portion of the bottom side of the second supply member is disposed in a state of being immersed in the liquid L which is stored in a container (not shown), and the liquid L which is adhered to the uneven pattern of the outer circumferential surface of the portion is supplied to the developing roll 74. However, if the liquid L may be supplied to the developing roll 74, the configuration of the second supply member may not be the configuration described above. For example, the liquid L may be supplied to the developing roll 74 using an ejecting head of a system (an ink jet system) in which the liquid L is rendered into droplets, and ejected to supply the liquid L to the developing roll 74. For example, in the first exemplary embodiment, a configuration may be adopted in which the liquid which is ejected by the ejecting head lands on the portion of the developing roll 74 which faces the charging device 76, and the supplying of the liquid by the ejecting head, the positive charging of the toner T in the developer G, and the forming of the electric field by the charging device 76 are performed at the same timing.

In the present specification, the description of each of the exemplary embodiments is given separately. However, embodiments in which elements of each of the exemplary embodiments are combined are included in the technical scope of the invention. For example, the power source PS of the second exemplary embodiment may be combined with the developing device 70D of the fourth exemplary embodiment, and the voltage of less than the discharge initiation voltage Vth may be applied to the second supply roll 78 of the fourth exemplary embodiment. The power source PS of the third exemplary embodiment may be combined with the developing device 70D of the fourth exemplary embodiment, and the voltage of greater than or equal to the discharge initiation voltage Vth may be applied to the second supply roll 78 of the fourth exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device, comprising:

a developing member that forms a first nip with a latent image forming member on which a latent image is formed, and develops the latent image as a toner image using a developer containing a toner and a first liquid;

a first supply member that forms a second nip with the developing member, and supplies the developer to the developing member; and a second supply member that faces the developing member at an upstream of the first nip in the developing member in a rotation direction of the developing member and at a downstream of the second nip, the second supply member having a second liquid adhered to an outer circumferential surface of the second supply member, and the second supply member supplying the second liquid adhered to the outer circumferential surface of the second supply member to the developing member, wherein when the second liquid adhered to the outer circumferential surface of the second supply member is supplied to the developing member by the second supply member, a thickness of a layer of the developer on the developing member is increased.

2. The developing device according to claim 1, wherein the second supply member forms an electric field that causes the toner in the developer that is supplied to the developing member by the first supply member to move from a second supply member side to a developing member side.

3. The developing device according to claim 2, wherein a voltage that is equal to a discharge initiation voltage in relation to the developing member or more is applied to the second supply member to form the electric field.

4. The developing device according to claim 2, further comprising:

an electric field forming member that faces the developing member at the upstream of the first nip in the developing member in the rotation direction of the developing member and at the downstream of a position at which the second supply member faces the developing member, and that forms an electric field that causes the toner in the developer that is supplied to the developing member by the first supply member to move from a liquid surface side of the developer to an outer circumferential surface side of the developing member.

5. The developing device according to claim 1, further comprising:

an electric field forming member that faces the developing member at the upstream of the first nip in the developing member in the rotation direction of the developing member and at the downstream of a position at which the second supply member faces the developing member, and that forms an electric field that causes the toner in the developer that is supplied to the developing member by the first supply member to move from a liquid surface side of the developer to an outer circumferential surface side of the developing member.

6. The developing device according to claim 1, wherein the second supply member is a rubber roll.

7. The developing device according to claim 1, wherein the second liquid and the first liquid are a same type of liquid.

8. An image forming apparatus, comprising:

an image holding member on which an electrostatic latent image is formed;

the developing device according to claim 1 that develops the latent image with a liquid developer; and a transfer unit that transfers a developer image developed by the developing device to a transfer receiver.

9. The image forming apparatus according to claim 8, wherein the second supply member of the developing device forms an electric field that causes the toner in the developer supplied to the developing member by the first supply member to move from the second supply member side to the developing member side.

10. The developing device according to claim 9, wherein a voltage that is equal to a discharge initiation voltage in relation to the developing member or more is applied to the second supply member to form the electric field.

11. The image forming apparatus according to claim 9, further comprising:

an electric field forming member that faces the developing member at the upstream of the first nip in the developing member in the rotation direction of the developing member and at the downstream of a position at which the second supply member faces the developing member, and that forms an electric field that causes the toner in the developer that is supplied to the developing member by the first supply member to move from a liquid surface side of the developer to an outer circumferential surface side of the developing member.

12. The image forming apparatus according to claim 8, further comprising:

an electric field forming member that faces the developing member of the developing device at the upstream of the first nip in the developing member in the rotation direction of the developing member and at the downstream of a position at which the second supply member faces the developing member, and that forms an electric field that causes the toner in the developer that is supplied to the developing member by the first supply member to move from a liquid surface side of the developer to an outer circumferential surface side of the developing member.

* * * * *